US012338702B2

(12) United States Patent
Rodgers

(10) Patent No.: US 12,338,702 B2
(45) **Date of Patent: *Jun. 24, 2025**

(54) OILFIELD UNITIZED WELLHEAD WITH INTEGRATED INTERNAL HANGER RETAINER SYSTEM

(71) Applicant: Doyle W. Rodgers, Gladewater, TX (US)

(72) Inventor: Doyle W. Rodgers, Gladewater, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/385,485

(22) Filed: Oct. 31, 2023

(65) Prior Publication Data

US 2024/0060382 A1 Feb. 22, 2024

Related U.S. Application Data

(63) Continuation of application No. 17/968,580, filed on Oct. 18, 2022, now Pat. No. 11,846,153.

(60) Provisional application No. 63/322,068, filed on Mar. 21, 2022.

(51) Int. Cl.
*E21B 33/04* (2006.01)
*E21B 17/08* (2006.01)

(52) U.S. Cl.
CPC ..... *E21B 33/04* (2013.01); *E21B 17/08* (2013.01)

(58) Field of Classification Search
CPC ..... E21B 33/04
See application file for complete search history.

(56) References Cited

U.S. PATENT DOCUMENTS 2,346,060 A * 4/1944 Yeatman ..... E21B 33/04 166/89.1
2,517,821 A * 8/1950 Allen ..... E21B 33/04 285/123.14
3,311,168 A * 3/1967 Pierce, Jr. ..... E21B 33/04 285/123.3
5,094,297 A * 3/1992 Bridges ..... E21B 33/04 166/208

(Continued)

FOREIGN PATENT DOCUMENTS

WO WO-2017123480 A1 * 7/2017 ..... E21B 33/04

*Primary Examiner* — Matthew R Buck
(74) *Attorney, Agent, or Firm* — Phillip Black; Dossey & Jones PLLC

(57) ABSTRACT

A unitized wellhead assembly includes a lower wellhead housing and an upper wellhead housing interconnected by internal and external threads and pressure sealed via a housing seal that creates a unitized body. The unitized wellhead assembly accepts casing and tubing hanger assemblies containing a plurality of individual retainer segments that engage mating grooves in the unitized body and also retains the casing and tubing hangers in place while containing the wellbore pressure. By eliminating the porting for external actuation devices that pass through the wall section of a wellhead housing, the potential for accidental release of wellbore gasses or fluids to the atmosphere and creation of a potentially hazardous or deadly situation is eliminated. Additionally, the configuration of the segmented retainers reduces high stresses when the retainers are forced outward and eliminates the potential to yield a retainer ring beyond the point of being able to return to its original shape.

17 Claims, 9 Drawing Sheets

(56) References Cited

U.S. PATENT DOCUMENTS

| | | | | |
|---|---|---|---|---|
| 5,725,056 | A * | 3/1998 | Thomson | E21B 33/03 166/208 |
| 7,134,490 | B2 * | 11/2006 | Nguyen | E21B 33/0422 166/208 |
| 7,950,466 | B2 * | 5/2011 | Rodgers | E21B 33/04 166/75.13 |
| 8,851,182 | B2 * | 10/2014 | Nguyen | E21B 33/043 166/360 |
| 11,846,153 | B2 * | 12/2023 | Rodgers | E21B 33/04 |
| 2021/0189823 | A1 * | 6/2021 | Hatten | E21B 33/04 |

* cited by examiner

OILFIELD UNITIZED WELLHEAD WITH INTEGRATED INTERNAL HANGER RETAINER SYSTEM

CROSS-REFERENCE TO RELATED APPLICATIONS

This application claims priority to provisional patent application No. 63/322,068, filed Mar. 21, 2022 and to the non-provisional patent application Ser. No. 17/968,580 filed on Oct. 18, 2022, which is hereby incorporated by reference in its entirety.

FIELD OF THE INVENTION

The present invention is directed to a unitized wellhead system having a lower and upper wellhead housing containing a lower and upper internal retainer system for retaining casing hangers, tubing hangers, or other related components.

BACKGROUND OF THE INVENTION

The retention of casing and tubing hangers is a requirement to creating safe, flexible, and reliable operations of high-pressure oilfield wellhead production systems. This type of control is currently achieved using externally actuated hanger retention mechanisms that pass radially through porting in a side wall of a wellhead housing. The porting for the externally actuated hanger retention mechanisms contain a sealing mechanism that prevents internal wellhead oil or gas from escaping to the atmosphere. These sealing mechanisms, unfortunately, have the potential to let pressure escape through the porting to the atmosphere. This creates a potentially dangerous or deadly hazard especially if $H_2S$ (Sour Gas) is present in the well bore.

Other wellhead systems utilize one-piece internal retainer rings that are intended to expand outward during the pumping process; this causes high stresses in the retainer ring that exceeds the yield strength of the ring, causing permanent distortion (plastic deformation). If the retainer ring does not return to its original shape, the hanger assembly cannot be removed from the wellhead, if needed. Additionally, one-piece retainer rings expand in an elliptical manner and do not engage the retainer groove circumference equally.

BRIEF SUMMARY OF THE INVENTION

The disclosed subject matter provides a unitized wellhead system having a wellhead body. The body contains internal grooves that are configured to accept a casing or tubing hanger assembly containing a plurality of mating individual retainer ring segments that engage the internal grooves in the wellhead body and retains the casing or tubing hanger assemblies in place while containing the wellbore pressure. This configuration eliminates the porting for external actuation devices, which also eliminates the risk for hazardous or potentially deadly situations stemming from the release of wellbore gasses or fluids into the atmosphere.

BRIEF DESCRIPTION OF THE DRAWINGS

The disclosed subject matter, objectives, and advantages thereof, will best be understood by reference to the following detailed description of an illustrative embodiment when read in conjunction with the accompanying drawings, wherein.

DETAILED DESCRIPTION

Reference now should be made to the drawings, in which the same reference numbers are used throughout the different figures to designate the same components.

It will be understood that, although the terms first, second, third, etc. may be used herein to describe various elements, these elements should not be limited by these terms. These terms are only used to distinguish one element from another element. Thus, a first element discussed below could be termed a second element without departing from the teachings of the present disclosure.

The terminology used herein is for the purpose of describing particular embodiments only and is not intended to be limiting. As used herein, the singular forms "a", "an", and "the" are intended to include the plural forms as well, unless the context clearly indicates otherwise. It will be further understood that the terms "comprises" and/or "comprising" or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Figure 1:
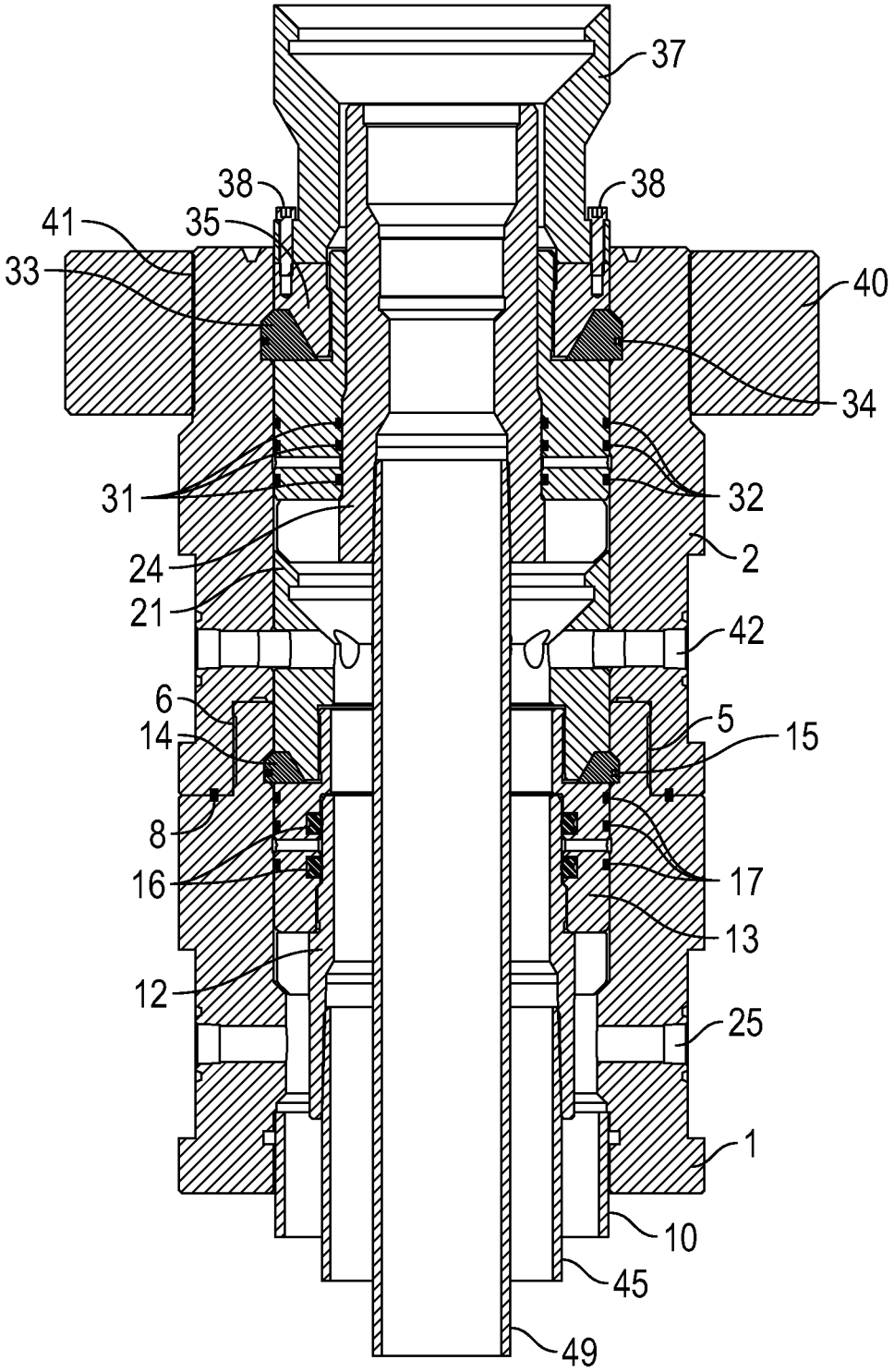
FIG. 1 depicts a side cross-sectional view of a unitized wellhead assembly having a mating lower and upper wellhead housing, as shown and described herein.

FIG. 1 depicts a side cross-sectional view of a unitized wellhead assembly having a mating lower and upper wellhead housing 1,2, as shown and described herein. Lower wellhead housing 1 includes lower internal groove 3 and upper wellhead housing 2 includes upper internal groove 4 (FIG. 2) which are each configured to accept a casing or tubing hanger assembly. The lower wellhead housing 1 and upper wellhead housing 2 are joined by engaging the external lower housing threads 6 and internal upper housing threads 5 via rotation of upper housing 2 in a downward direction until all rotation ceases. A pressure tight connection to contain the wellbore pressure between the lower wellhead housing 1 and upper wellhead housing 2 is achieved by inserting a housing seal 8 into a mating groove 9 located in the lower wellhead housing 1 and upper wellhead housing 2. The lower housing 1 is configured to accept a casing joint 10 inserted into the bottom slip of bore 11 and is secured in place by welding, in embodiments. Lower housing 1 may also accept a lower mandrel casing/tubing hanger 12 and a lower intermediate packoff assembly having a lower packoff bushing 13 and lower retainer segments 14 held in place by a lower external retainer ring 15. The lower packoff assembly also includes a plurality of lower internal elastomer seals 16 and a plurality of lower external elastomer seals 17 configured to contain wellbore pressure below lower mandrel casing/tubing hanger 12. The lower packoff assembly and lower mandrel casing/tubing hanger 12 is secured in place by engaging support bushing internal threads 22 of a support bushing 21 with lower packoff bushing external threads 18 and rotating support bushing 21 in a downward direction, causing the tapered external shoulder of the support bushing 21 to push against the tapered internal diameter of the lower retainer segments 14, moving the lower retainer segments 14 radially outward into the mating lower internal groove 3. Lower retainer segments 14 may be fully outwardly expanded when rotation of support bushing 21 ceases. At this point, an upper production mandrel casing/tubing hanger 24 is installed within the unitized wellhead assembly followed by the installation of an upper packoff bushing 29. The production packoff assembly (see FIG. 7) and upper production mandrel casing/tubing hanger 24 is secured in place by engaging upper segment actuation ring internal threads 36 of an upper segment actuation ring 35 with upper packoff bushing external threads 30 which rotates the upper segment actuation ring 35 in a downward direction and causes the tapered external shoulder 46 of the upper segment actuation ring 35 to push against the tapered internal diameter of the upper retainer segments 33, moving the upper retainer segments 33 radially outward into the mating shoulder 50 of upper internal groove 4. Upper retainer segments 33 may be fully outwardly expanded when rotation of the upper packoff bushing 29 ceases.

Figure 2:
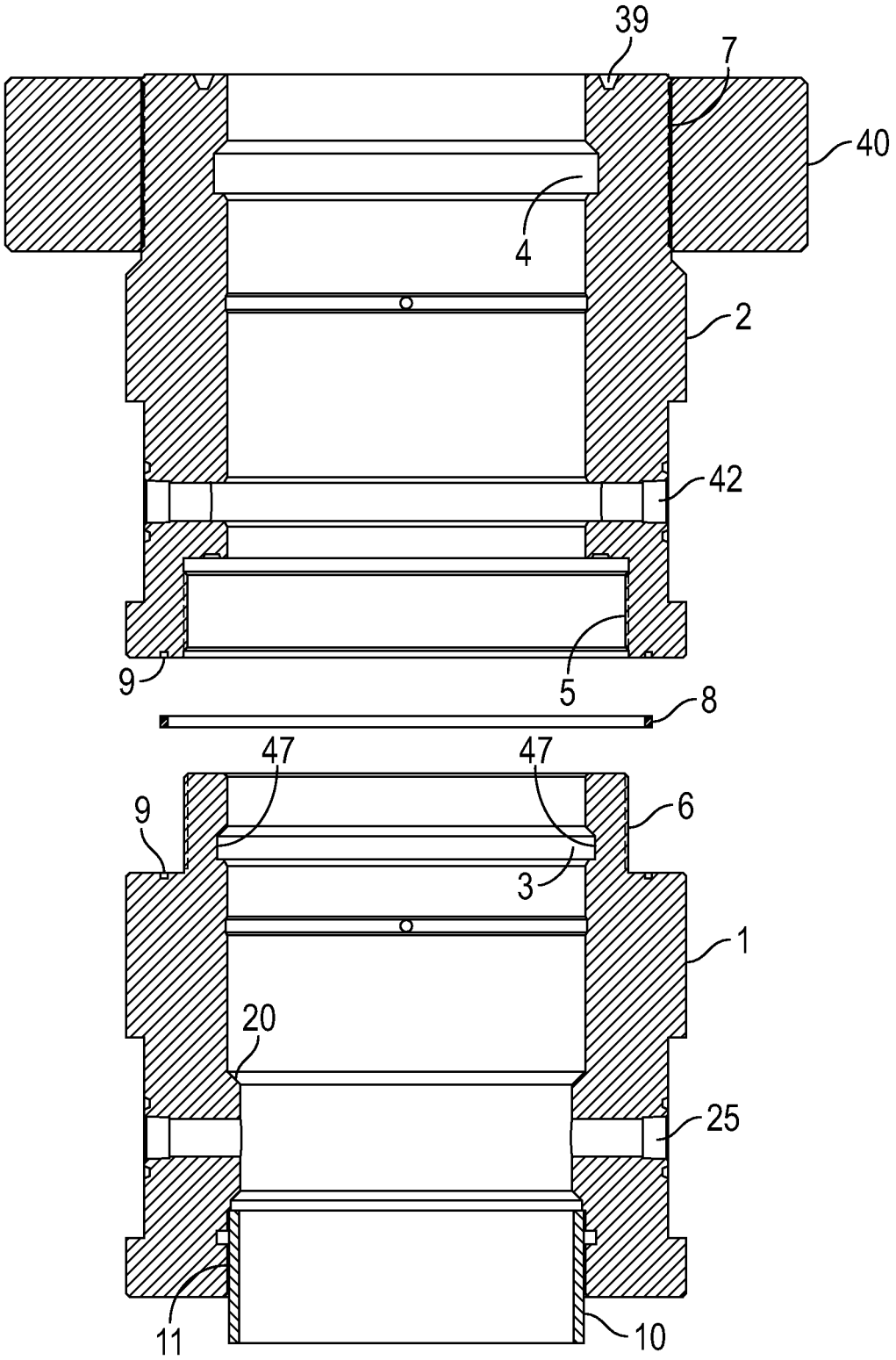
FIG. 2 depicts an exploded side cross-sectional view of wellhead housings of a unitized wellhead assembly containing internal grooves and a wellhead housing seal, as shown and described herein.

FIG. 2 depicts an exploded side cross-sectional view of wellhead housings 1,2 of a unitized wellhead assembly containing internal grooves 3,4 and a wellhead housing seal 8, as shown and described herein. A bore 11 located at the bottom of lower wellhead housing 1 is configured to receive and attach (weld) to the casing joint 10 in order to provide a pressure tight connection between a surface casing and the unitized wellhead assembly. As presented, this bottom connection between casing joint 10 and lower wellhead housing 1 may comprise a variety of configurations for affixing casing joint 10 in a proper positioning; the affixing means may include but is not limited to welding and threaded attachment.

Lower wellhead housing 1 further includes an internal shoulder 20 positioned around an inner circumference of lower wellhead housing 1 and is configured to support the lower mandrel casing/tubing hanger 12 when hanger 12 is positioned within lower wellhead housing 1. Lower outlets 25 may be disposed about a lower end of lower wellhead housing 1 while upper outlets 42 may be disposed about a lower end of upper wellhead housing 2; each of the lower outlets 25 and upper outlets 42 are configured to provide a pathway for freshly pumped wellbore oil. Upper wellhead housing 2 further includes a ring gasket groove 39 configured to receive a ring gasket so that upper wellhead housing 2 can form a pressure tight connection with an additional component (such as, but not limited to drive mandrel 37).

Figure 3:
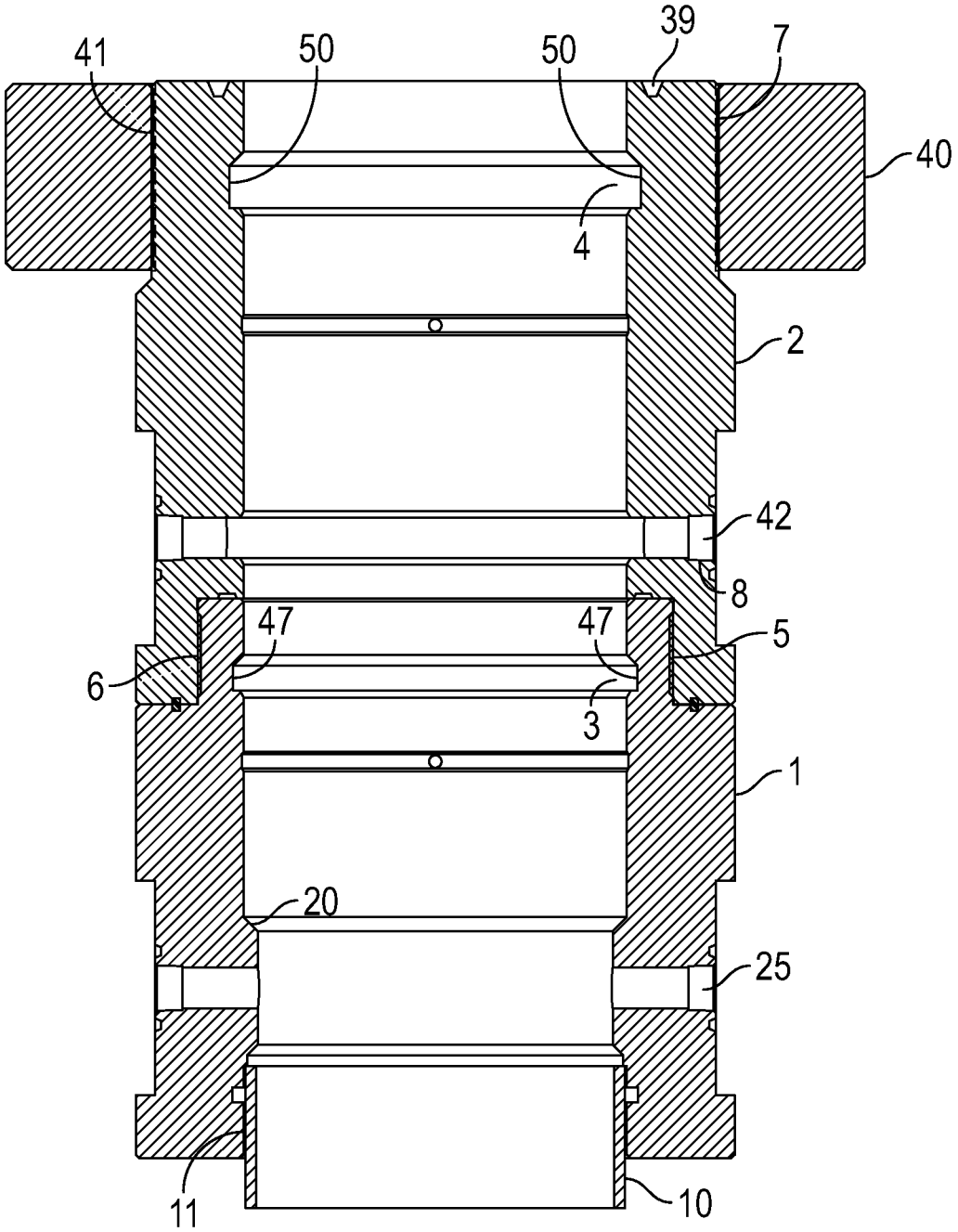
FIG. 3 depicts an exploded side cross-sectional view of assembled wellhead housings of a unitized wellhead assembly, as shown and described herein.

Housing seal 8 is shown positioned between lower wellhead housing 1 and upper wellhead housing 2. When lower wellhead housing 1 and upper wellhead housing 2 are affixed to one another, as shown in FIG. 3, housing seal 8 may sit within mating grooves 9 of lower and upper wellhead housings 1,2 so that a pressure tight seal is made between lower and upper wellhead housings 1,2.

Figure 4:
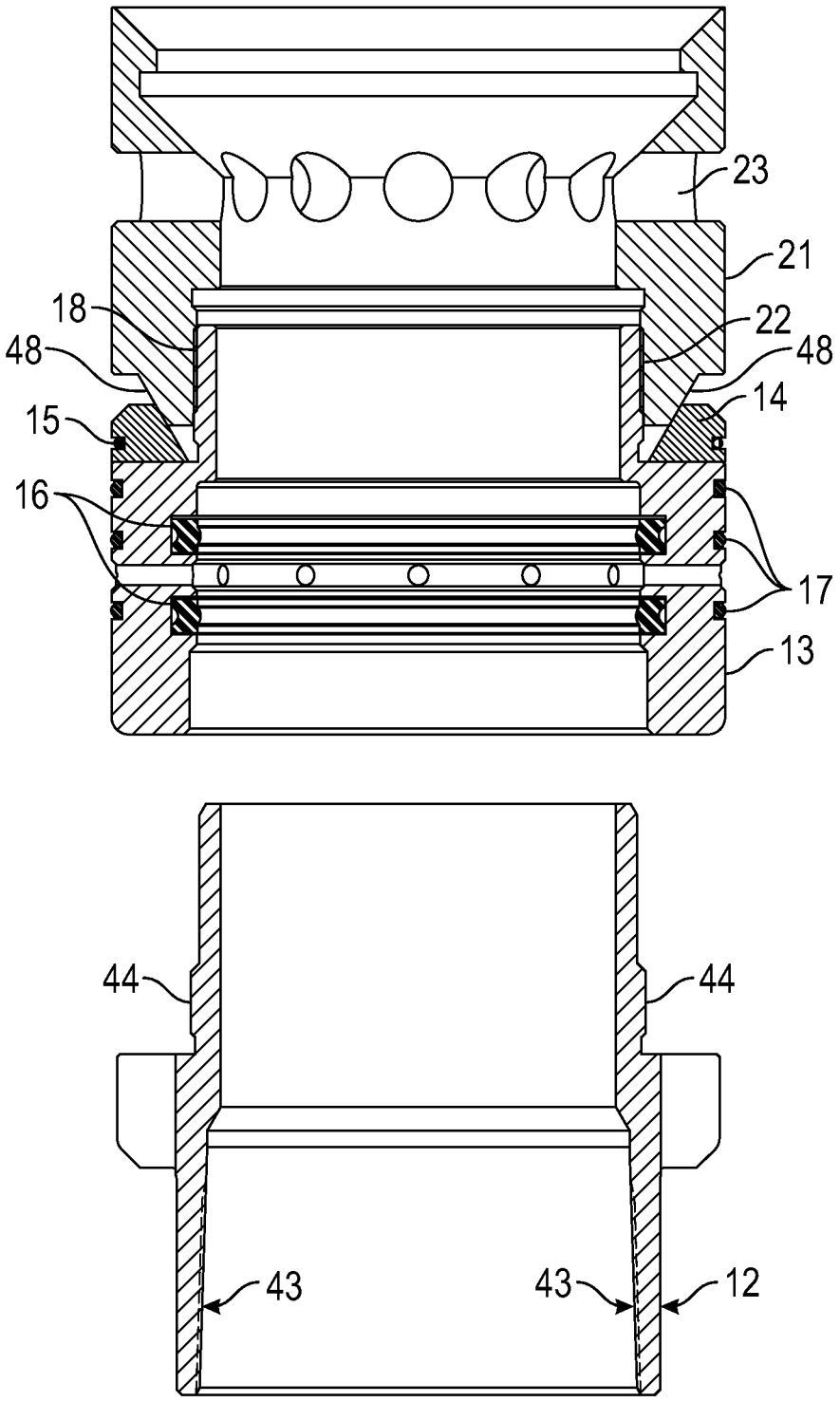
FIG. 4 depicts an exploded view of a lower mandrel casing/tubing hanger and lower packoff assembly of a unitized wellhead assembly, as shown and described herein.

FIG. 4 depicts an exploded view of a lower mandrel casing/tubing hanger 12 and lower packoff assembly of a unitized wellhead assembly, as shown and described herein. The lower mandrel casing/tubing hanger 12 includes lower casing/tubing internal threads 43 for suspending pipe and lower casing/tubing external threads 44 for effectively attaching to lower packoff bushing 13. The lower packoff assembly includes a lower packoff bushing 13, lower retainer segments 14, lower external retainer ring 15, and support bushing 21. The support bushing 21 has a plurality of radial orifices 23 to allow wellbore oil or gas to flow through the wall of support bushing 21 and into the bore of upper wellhead housing 2 and in turn, exit upper wellhead housing 2 through the upper outlets 42 into a series of valves and piping (not depicted) to direct the wellbore oil or gas to a collection area. The support bushing 21 contains internal threads 22 that engage external threads 18 of the lower packoff bushing 13, joining the components into a unitized assembly. The lower packoff bushing 13, in addition, contains internal elastomer seals 16 and external elastomer seals 17 configured to assist in creating pressure tight connections between lower packoff assembly and components such as, but not limited to lower mandrel casing/tubing hanger 12 and lower wellhead housing 1.

Figure 5:
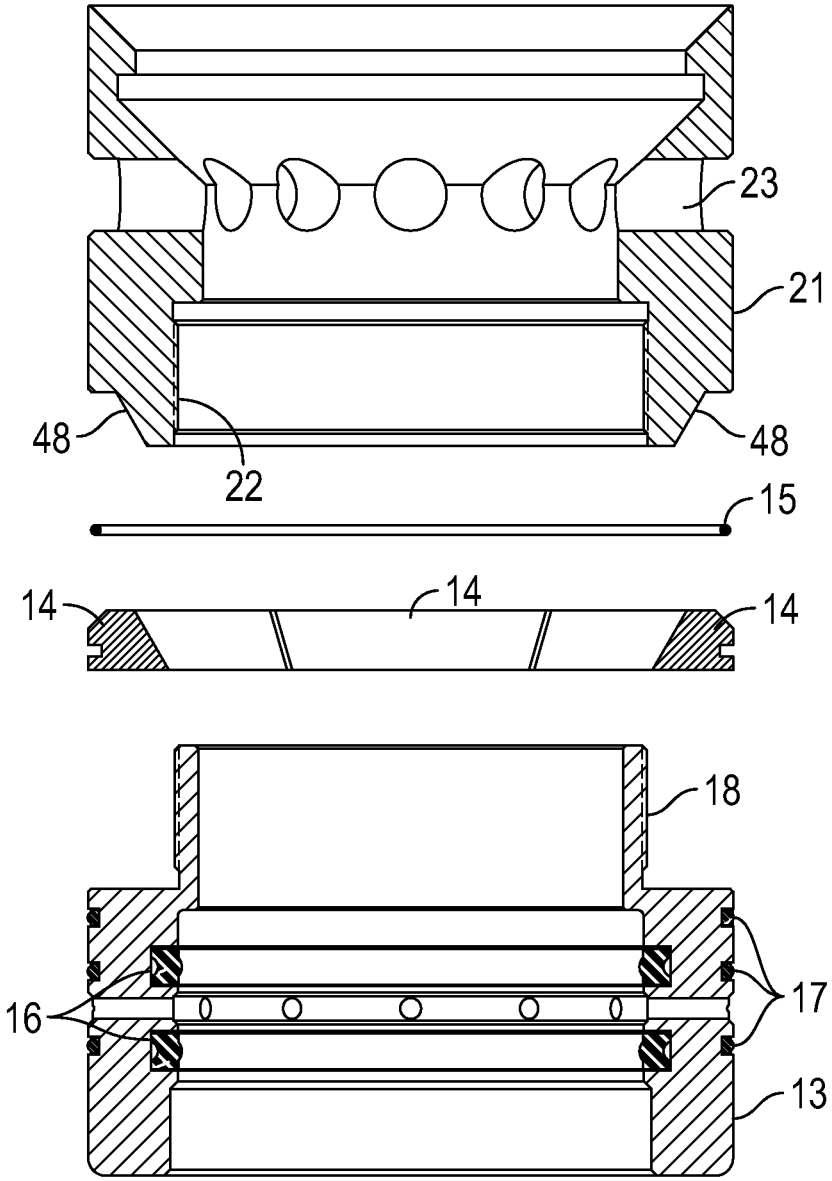
FIG. 5 depicts an exploded view of a lower packoff assembly, as shown and described herein.

FIG. 5 illustrates an exploded view of a lower packoff assembly, as shown and described herein. As shown, lower packoff assembly is divided into its main components: lower packoff bushing 13, lower retainer segments 14, lower external retainer ring 15, and support bushing 21. Lower packoff bushing 13 includes external threads 18 configured to engage support bushing internal threads 22, internal elastomer seals 16, and external elastomer seals 17. The lower retainer segments 14 are held in place around lower packoff bushing 13 and support bushing 21 via the compression force applied by lower external retainer ring 15. Support bushing 21 additionally includes a plurality of holes 23 to allow fluid or gas to pass through and out of the lower packoff assembly.

Figure 6:
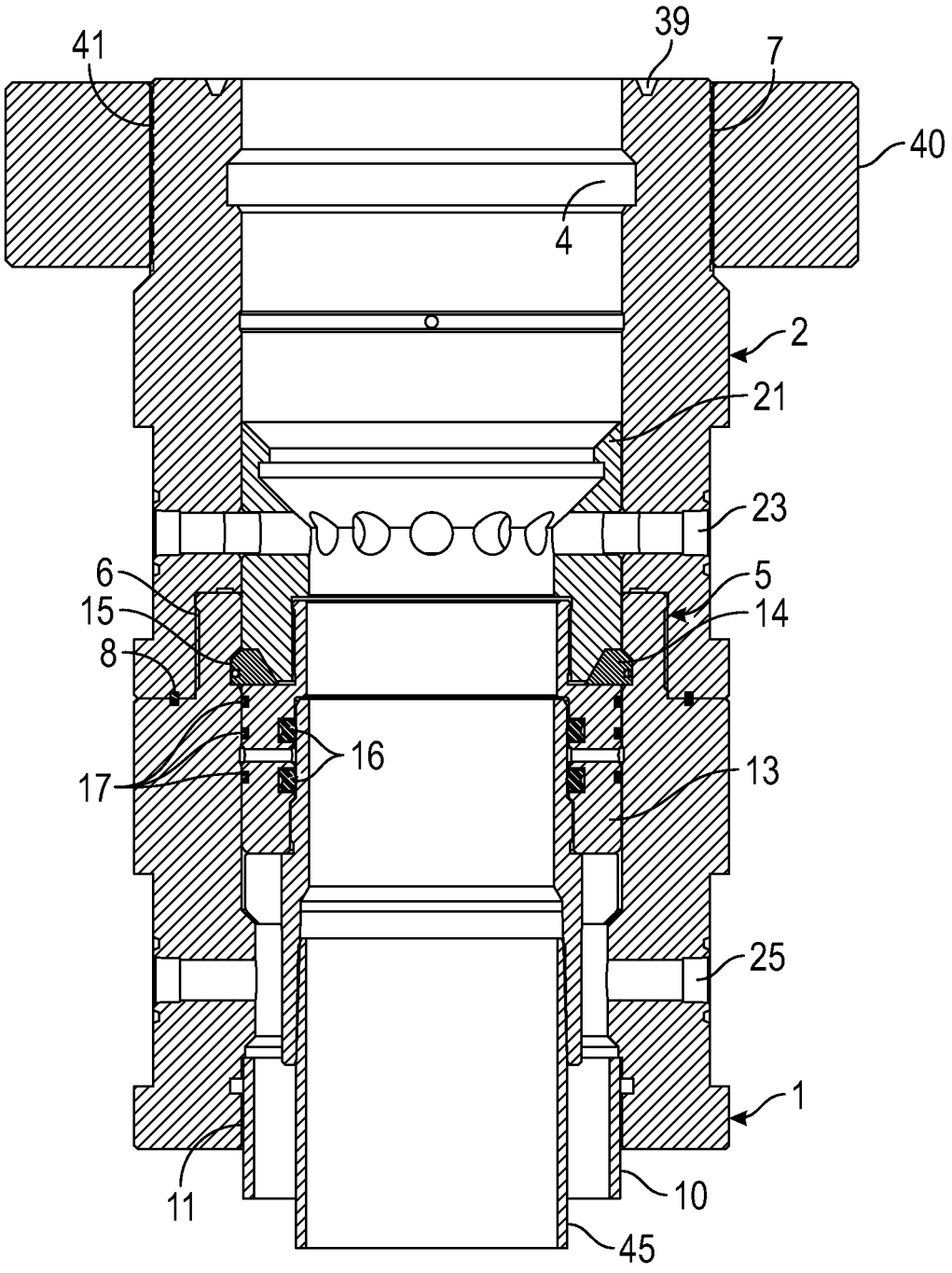
FIG. 6 an assembled view of a lower mandrel casing/tubing hanger affixed to lower packoff assembly disposed within a unitized wellhead assembly, as shown and described herein.

FIG. 6 depicts an assembled view of a lower mandrel casing/tubing hanger 12 affixed to lower packoff assembly disposed within a unitized wellhead assembly, as shown and described herein. The lower wellhead housing 1 and upper wellhead housing 2 are joined together by the lower wellhead housing external threads 6 and the upper wellhead housing internal threads 5. The lower mandrel casing/tubing hanger 12 is retained in place by the lower retainer segments 14. In order to provide effective retainment of lower mandrel casing/tubing hanger, lower retainer segments 14 are extended radially via the tapered nose 48 of support bushing 21 as the support bushing internal thread 22 is rotated in a downward direction until the lower retainer segments 14 are fully extended and contacting the mating shoulder 47 of the lower internal groove 3. Lower mandrel casing/tubing hanger 12, as a result, is secured in place and contains wellbore pressure using the internal elastomer seals 16 and external elastomer seals 17.

Figure 7:
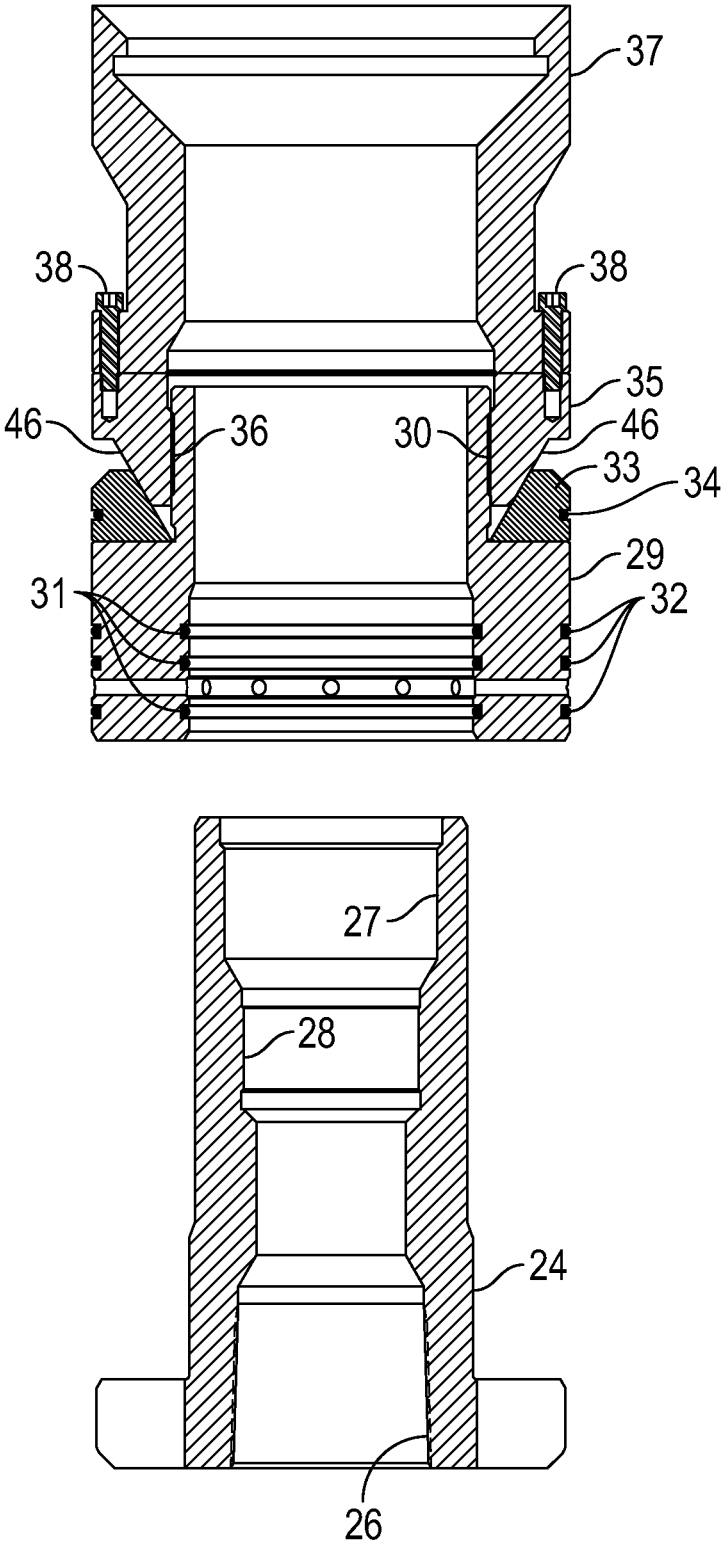
FIG. 7 depicts an exploded view of an upper production mandrel casing/tubing hanger separated from production packoff assembly, as shown and described herein.

FIG. 7 depicts an exploded view of an upper production mandrel casing/tubing hanger 24 separated from production packoff assembly, as shown and described herein. Production packoff assembly includes upper packoff bushing 29 having internal elastomer seals 31 and external elastomer seals 32, upper retainer segments 33, upper external retainer ring 34 to hold the upper retainer segments 33 in place, and upper segment actuation ring 35. Drive mandrel 37 may be affixed to an upper surface of upper segment actuation ring 35 using cap screws 38. Upper production mandrel casing/tubing hanger 24, shown below production packoff assembly, includes upper production casing/tubing lower internal threads 26 to effectively suspend a string of production casing 49. Production mandrel casing/tubing hanger 24 also includes intermediate internal threads 28 to receive a back pressure valve (not depicted) to contain pressure below the upper production mandrel casing/tubing hanger 24 and the production packoff assembly. Upper production mandrel casing/tubing hanger 24 is lowered into the wellhead assembly by installing a threaded pipe into the upper production mandrel casing/tubing upper internal threads 27.

Figure 8:
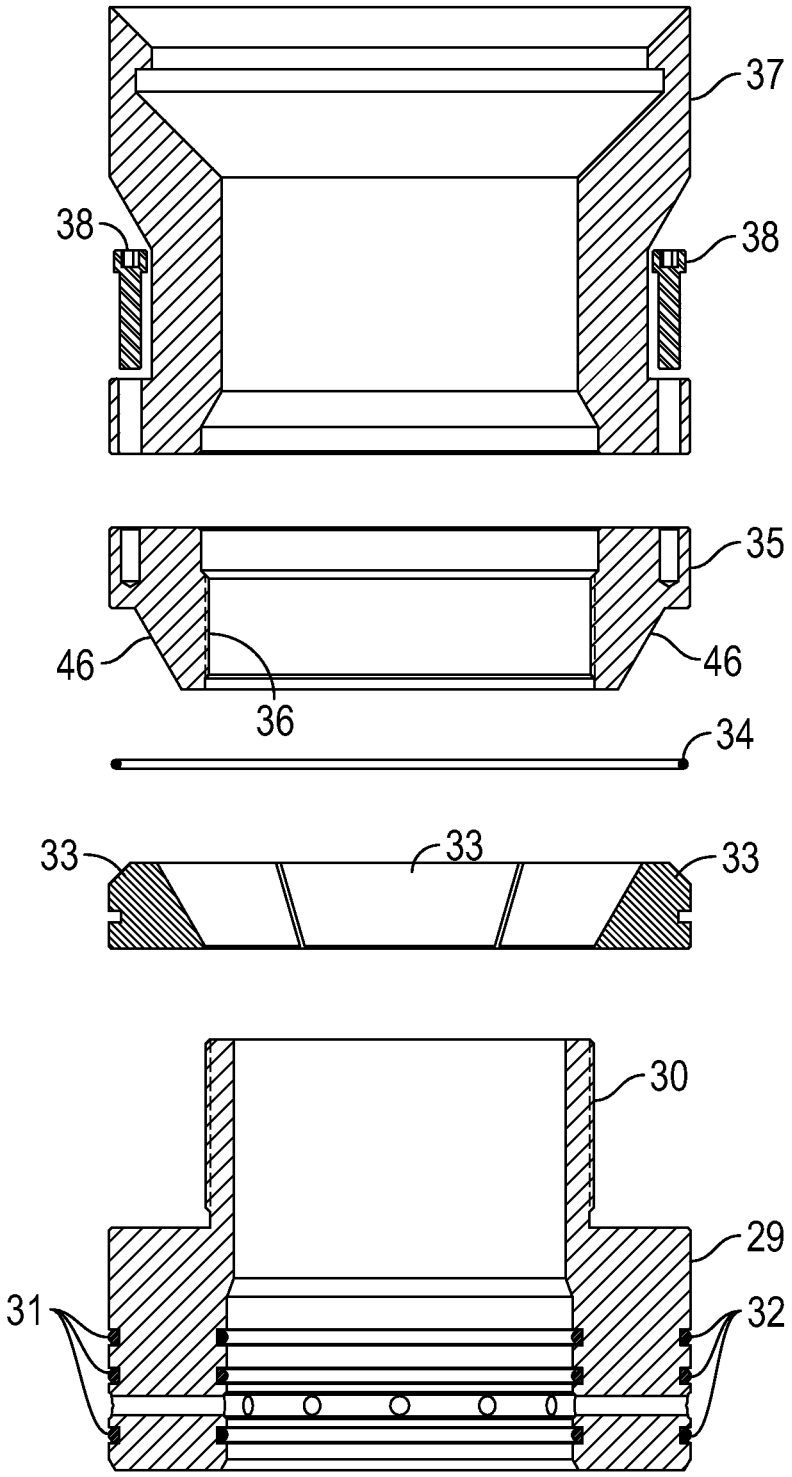
FIG. 8 depicts an exploded view of a production packoff assembly, as shown and described herein.

FIG. 8 depicts an exploded view of a production packoff assembly, as shown and described herein. As shown, production packoff assembly is divided into its main components: upper packoff bushing 29, upper retainer segments 33, upper external retainer ring 34, and upper segment actuation ring 35. Upper packoff bushing 29 includes external threads 30 configured to engage upper segment actuation ring internal threads 36, internal elastomer seals 31, and external elastomer seals 32. The upper retainer segments 33 are held in place around upper packoff bushing 29 and upper segment actuation ring 35 via the compression force applied by upper external retainer ring 34. Upper segment actuation ring 35 additionally includes a drive mandrel 37 affixed to a top surface of upper segment actuation ring via cap screws 38.

Figure 9:
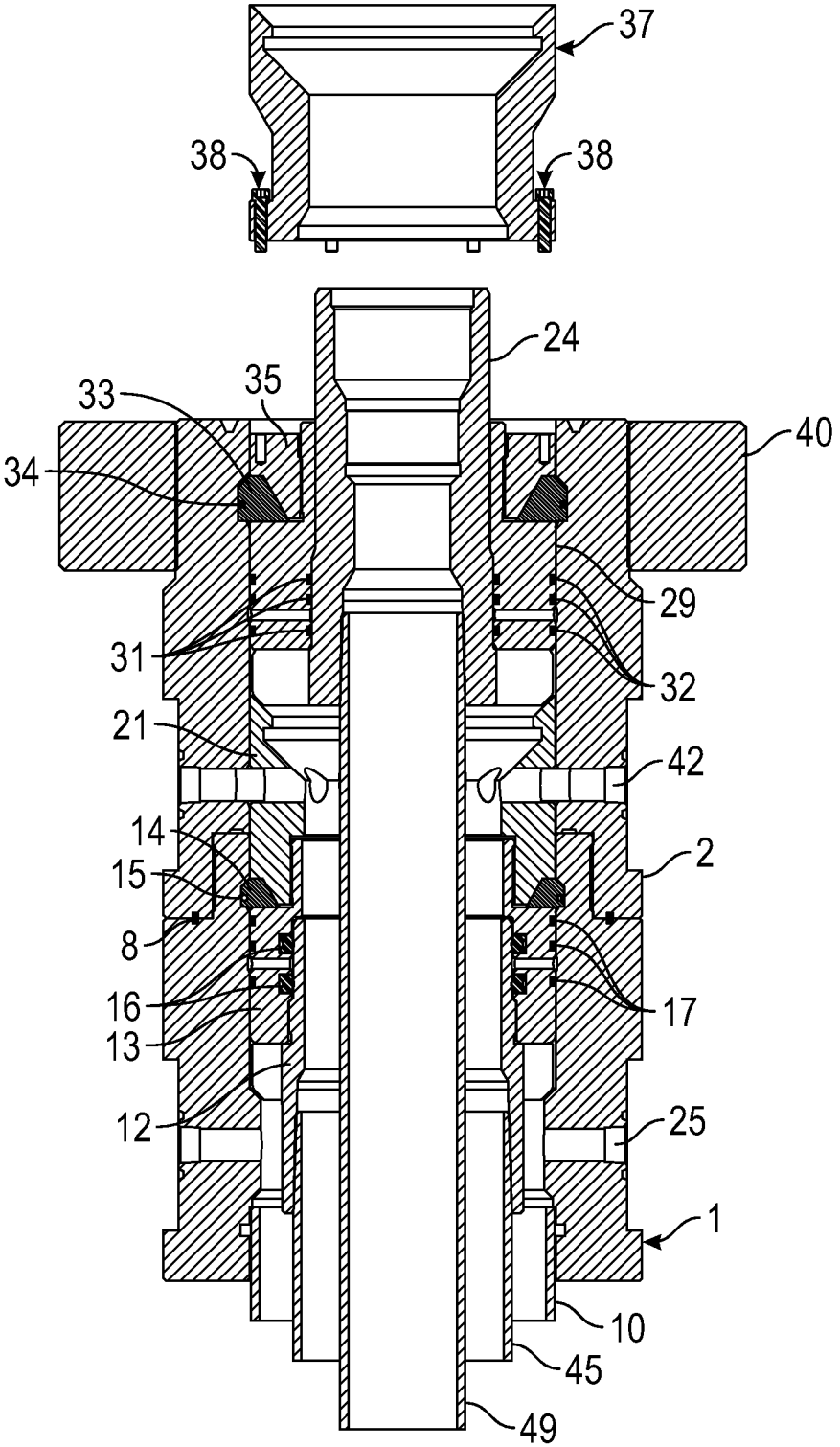
FIG. 9 depicts a unitized wellhead assembly with a drive mandrel removed, as shown and described herein.

FIG. 9 depicts a unitized wellhead assembly with a drive mandrel 37 removed, as shown and described herein. As shown, lower wellhead housing 1 includes lower internal groove 3 and upper wellhead housing 2*u* includes upper internal groove 4. Lower wellhead housing 1 and upper wellhead housing 2 are joined by engaging external lower housing threads 6 and internal upper housing threads 5 by rotating upper wellhead housing 2 in a downward direction until all rotation ceases. A pressure tight connection to contain the wellbore pressure between lower wellhead housing 1 and upper wellhead housing 2 is achieved by inserting housing seal 8 into a mating groove 9 formed by lower wellhead housing 1 and upper wellhead housing 2. The lower wellhead housing 1 may accept a casing joint 10 inserted into the bottom slip within bore 11 and is secured in place by welding, in embodiments. Lower wellhead housing 1 may also accept a lower mandrel casing/tubing hanger 12 configured to suspend a string of intermediate casing 45 and a lower packoff assembly having a lower packoff bushing 13 and individual lower retainer segments 14 held in place by a lower external retainer ring 15. The lower packoff assembly also includes a plurality of lower internal elastomer seals 16 and lower external elastomer seals 17 to contain well bore pressure below the lower mandrel casing/tubing hanger 12. The lower packoff assembly and lower mandrel casing/tubing hanger 12 is secured in place via engagement of support bushing internal threads 22 with lower packoff bushing external threads 18 and rotating support bushing 21 in a downward direction, causing the tapered external shoulder 46 of the support bushing 21 to push against the tapered internal diameter of the lower retainer segments 14, moving the lower retainer segments 14 radially outward into the mating lower internal groove 3. The lower retainer segments 14 are considered to be fully expanded when rotation of support bushing 21 ceases. At this point, the upper production mandrel casing/tubing hanger 24 is installed followed by the installation of upper packoff bushing 29. The production packoff assembly and upper production mandrel casing/tubing hanger 24 is secured in place by engaging the upper segment actuation ring internal threads 36 with the production packoff bushing external threads 30, moving the upper segment actuation ring 35 in a downward direction and causing the tapered external shoulder 46 of the upper segment actuation ring 35 to push against the tapered internal diameter of the upper retainer segments 33, moving them radially outward into the mating upper internal groove 4. Upper retainer segments 33 are fully expanded when rotation of upper packoff bushing 29 ceases. Upon securing the production packoff assembly by expanding upper retainer segments 33, the drive mandrel 37 and cap screws 38 are removed.

It is noted that lower retainer segments 14 and upper retainer segments 33, when compared to one-piece retainer rings, may reduce high/higher stresses when segments 14,33 are forced outward (due to the segmentation) and may eliminate the potential to yield a retainer ring beyond the point of being able to return to its original shape (plastic deformation). In addition, individual segments of lower and upper retainer segments 14,33 require less torque in order to expand outwardly into respective lower and upper internal grooves 3,4. The individual segments of segments 14,33 may mate with lower and upper internal grooves 3,4 in the unitized wellhead housing in a circumferential manner, which eliminates elliptical deviation that is found in one-piece retainer rings.

For the purposes of this disclosure, the terms "threads" and "threading" may be synonymous.

For the purposes of this disclosure, the terms "seal groove" and "mating groove" may be synonymous.

For the purposes of this disclosure, each of the terms "casing hanger assembly" and "tubing hanger assembly" may be synonymous with each of the terms "hanger", "lower packoff assembly", "production packoff assembly", and "internal retention system."

A plurality of additional features and feature refinements are applicable to specific embodiments. These additional features and feature refinements may be used individually or in any combination. It is noted that each of the following features discussed may be, but are not necessary to be, used with any other feature or combination of features of any of the embodiments presented herein.

Unless otherwise defined, all technical and scientific terms used herein have the same meanings as are commonly understood by one of ordinary skill in the art to which this disclosure belongs. Although methods similar or equivalent to those described herein can be used in the practice or testing of the present disclosure, suitable methods are described herein.

All publications, patent applications, patents, and other references mentioned herein are incorporated by reference in their entirety. In case of conflict, the patent specification, including definitions, will prevail. In addition, the materials, methods, and examples are illustrative only and not intended to be limiting.

It will be appreciated by persons skilled in the art that the present disclosure is not limited to what has been particularly shown and described hereinabove. Rather, the scope of the present disclosure is defined by the appended claims and includes both combinations and sub-combinations of the various features described hereinabove as well as variations and modifications thereof, which would occur to persons skilled in the art upon reading the foregoing description.

I claim:

1. A wellhead assembly, comprising:

a lower wellhead housing;

an upper wellhead housing affixed to the lower wellhead housing, the upper wellhead housing and the lower wellhead housing forming a wellhead body;

a bore extending from a bottom end of the lower wellhead housing to a top end of the upper wellhead housing, the bore configured to receive a casing joint at the bottom end of the lower wellhead housing and create a pressure tight connection between a surface casing disposed in the casing joint and the wellhead assembly;

wherein the wellhead body comprises a first packoff assembly positioned between a first hanger and the wellhead body and a second packoff assembly positioned between a second hanger and the wellhead body, wherein the lower wellhead housing further comprises an internal shoulder configured to receive a respective one of the first hanger and the second hanger, and wherein the first packoff assembly, the second packoff assembly, the first hanger, and the second hanger are supported by the internal shoulder.

2. The assembly of claim 1, wherein the lower wellhead housing and the upper wellhead housing are removably affixable to one another via sealing engagement of an internal threading with an external threading and are configured to encapsulate a housing seal within a lower mating groove of the lower wellhead housing and an upper mating groove of the upper wellhead housing to create a unitized body.

3. The assembly of claim 1, wherein each of the first packoff assembly and the second packoff assembly comprise a respective one of a pair of bushings.

4. The assembly of claim 3, wherein each bushing of the pair of bushings comprise internal and external elastomer seals configured to provide pressure tight connections between the first and second hangers and the wellhead body.

5. The assembly of claim 3, wherein each of the first hanger and the second hanger are threadably affixable to a respective one of the pair of bushings.

6. The assembly of claim 1, wherein a first sealing engagement of the upper wellhead housing and the lower wellhead housing is positioned adjacent a second sealing engagement of a respective one of the first and second packoff assemblies and a respective one of the first and second hangers.

7. The assembly of claim 1, wherein a respective one of the first and second hangers retains an intermediate casing and a respective other of the first and second hangers retains a production casing.

8. The assembly of claim 1, wherein each of the first packoff assembly and the second packoff assembly comprise a respective one of a pair of segmented retainers for isolating pressure within the wellhead body and for securing each of the first packoff assembly and the second packoff assembly to the wellhead body.

9. The assembly of claim 8, wherein each of the pair of segmented retainers is configured to expand outward into a respective one of a first internal groove and a second internal groove of the wellhead body when a compression force is applied to each of the pair of segmented retainers.

10. The assembly of claim 9, wherein the compression force applied to a lower one of the pair of segmented retainers occurs via threaded attachment of a support bushing to a lower packoff bushing and the compression force applied to an upper one of the pair of segmented retainers occurs via threaded attachment of an actuation ring to an upper packoff bushing.

11. The assembly of claim 10, wherein an upper one of the first and second packoff assemblies is positioned on top of the lower packoff bushing.

12. The assembly of claim 10, wherein the upper segmented retainer circumnavigates the threaded attachment of the support bushing to the lower packoff bushing and the lower segmented retainer circumnavigates the threaded attachment of the actuation ring to the upper packoff bushing.

13. The assembly of claim 1, wherein the lower wellhead housing comprises a plurality of lower outlets and the upper wellhead housing comprises a plurality of upper outlets, the lower outlets and the upper outlets each disposed about the wellhead body.

14. The assembly of claim 1, wherein the upper wellhead housing comprises a gasket groove configured to receive a ring gasket and form a pressure tight connection with a drive mandrel.

15. The assembly of claim 5, wherein both of the first packoff assembly and the second packoff assembly are configured to be structurally devoid of external retention devices.

16. A method for supporting a casing string within a well, comprising:

providing an upper wellhead housing affixed to a lower wellhead housing, the upper wellhead housing and the lower wellhead housing forming a wellhead body in which a bore is positioned;

sealingly engaging a first packoff assembly to a first hanger and suspending an intermediate casing string of the casing string from the first hanger;

installing the sealingly engaged first packoff assembly and first hanger in the wellhead body, wherein the first packoff assembly sealingly engages the internal perimeter of the wellhead body and the first hanger abuts and is supported by an internal shoulder of the lower wellhead housing;

sealingly engaging a second packoff assembly to a second hanger and suspending a production casing string of the casing string from the second hanger; and installing the sealingly engaged second packoff assembly and second hanger in the wellhead body, wherein the second packoff assembly sealingly engages the internal perimeter of the wellhead body and wherein the first packoff assembly, the second packoff assembly, the first hanger, the second hanger, the intermediate casing string, and the production casing string are supported by the internal shoulder.

17. The method of claim 16, wherein each of the first packoff assembly and the second packoff assembly comprise a respective one of a pair of segmented retainers for isolating pressure within the wellhead body and for securing each of the first packoff assembly and the second packoff assembly to the wellhead body.

* * * * *